US011820577B2

(12) United States Patent
Bickford

(10) Patent No.: US 11,820,577 B2
(45) Date of Patent: Nov. 21, 2023

(54) STATIC MIXER

(71) Applicant: L'OREAL, Paris (FR)

(72) Inventor: William Robert Bickford, Scotch Plains, NJ (US)

(73) Assignee: L'Oreal, Paris (FR)

( * ) Notice: Subject to any disclaimer, the term of this patent is extended or adjusted under 35 U.S.C. 154(b) by 202 days.

(21) Appl. No.: 17/364,055

(22) Filed: Jun. 30, 2021

(65) Prior Publication Data

US 2023/0002139 A1 Jan. 5, 2023

(51) Int. Cl.
*B65D 81/32* (2006.01)
*A45D 34/04* (2006.01)
*A45D 34/00* (2006.01)

(52) U.S. Cl.
CPC ..... *B65D 81/3261* (2013.01); *A45D 34/04* (2013.01); *A45D 2034/005* (2013.01); *A45D 2200/058* (2013.01)

(58) Field of Classification Search
CPC ..... B65D 81/3238; B65D 81/3261; B65D 81/3288; A45D 2034/005; A61J 1/2093; B01F 25/4231; B01F 33/50111; B01F 35/7164
USPC ..... 206/219–221, 568; 222/135, 145.5, 222/145.6; 366/336
See application file for complete search history.

(56) References Cited

U.S. PATENT DOCUMENTS 10,494,167 B2 12/2019 Kojima et al.
2006/0133197 A1 6/2006 Hefele
2007/0108231 A1 5/2007 Gray et al.
2012/0187148 A1* 7/2012 Ettlin ..... B05C 17/00593 222/137
2013/0126557 A1* 5/2013 Turner ..... B01F 25/43141 222/137
2014/0117045 A1* 5/2014 Varga ..... B29B 7/582 222/145.5
2015/0298865 A1* 10/2015 Kolb ..... B65D 35/44 222/145.5
2017/0144187 A1* 5/2017 Springhorn ..... B01F 25/43141
2020/0164323 A1 5/2020 Müller et al.

FOREIGN PATENT DOCUMENTS

CH 600937 A5 6/1978
JP 4290941 B2 7/2009
JP 6064273 B2 1/2017
WO 2011/032627 A1 3/2011
WO 2019/234083 A1 12/2019

OTHER PUBLICATIONS

Rapport De Recherche Préliminaire / Opinion Écrite Sur La Brevetabilité De L'Invention dated May 31, 2022, issued in corresponding French Application No. 2111140, filed Oct. 20, 2021, 7 pages.

* cited by examiner

*Primary Examiner* — Luan K Bui
(74) *Attorney, Agent, or Firm* — Christensen O'Connor Johnson Kindness PLLC

(57) ABSTRACT

A static mixer suitable for mixing liquids, pastes, creams, gels or other fluids. Fluids introduced into a static mixing cavity of the static mixer are mechanically mixed by the static mixing cavity, and then dispensed from an outlet as a mixed fluid. The static mixer may be formed by two housing halves that are hingedly connected so that the static mixer can be easily opened for cleaning the static mixing cavity.

11 Claims, 7 Drawing Sheets

STATIC MIXER

TECHNICAL FIELD

Embodiments of the present disclosure relate to a static mixer for use with one or more fluids, such as one or more cosmetic formulations. Embodiments of the static mixer allow for the user to clean the static mixer in a simplified manner for reuse. Embodiments of the present disclosure also relate to methods for mixing one or more fluids, such as cosmetic formulations.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with an aspect of the present disclosure, an apparatus is provided, which comprises a housing having housing halves hingedly connected at one end, the housing halves configured to pivot with respect to the other about a hinge from a closed position to an open position. The apparatus also includes a static mixing cavity disposed in the housing, the static mixing cavity configured to promote mixing of one or more fluids supplied thereto, and at least one fluid inlet and at least one fluid outlet each disposed in fluid communication with the static mixing chamber.

In some embodiments, the static mixing cavity defines a fluid mechanical mixing path.

In some embodiments, the housing includes a plurality of baffles arranged to form the mechanical mixing path.

In some embodiments, the housing halves each include baffles of the plurality of baffles, the baffles cooperatingly configured to form a mechanical mixing cavity.

In some embodiments, the hinge is a living hinge interconnecting the first housing halve to the second housing halve.

In some embodiments, the housing is integrally formed.

In accordance with another aspect of the present disclosure, a fluid mixing system is provided, which comprises first and second fluid cartridges having first and second fluid connector fittings, respectively, the first and second cartridges having a flexible housing configured so that when pressed, forces are applied to a fluid contained therein. The system also includes a static mixer. In an embodiment, the static mixer includes a housing, first and second connector ports configured to be removably coupled to the first and second fluid connector fittings, a static mixing cavity disposed in the housing and connected in fluid communication with the first and second connector ports, the static mixing cavity configured to promote mixing of one or more fluids supplied thereto, and a fluid outlet disposed in fluid communication with the static mixing chamber for dispensing a mixing fluid.

In some embodiments, the static mixing chamber is configured to mechanically mix fluid from the first and second cartridges as the fluid passes through the static mixing chamber.

In some embodiments, the housing includes a plurality of baffles arranged to form the mechanical mixing path in the static mixing cavity.

In some embodiments, one or more of the plurality of baffles includes a hole for fluid passage through the baffle.

In some embodiments, the fluid mixing system further comprises check valves associated with the one of the first and second connector ports or the first and second fluid connector fittings.

In some embodiments, the housing includes first and second housing halves hingedly connected at one end, the first and second housing halves configured to pivot with respect to the other about a hinge from a closed position to an open position.

In some embodiments, the hinge is a living hinge interconnecting the first housing halve to the second housing halve.

In accordance with another aspect of the present disclosure, a fluid mixing system is provided. In an embodiment, the system includes first and second fluid reservoirs storing first and second fluids, and a static mixer. In an embodiment, the static mixer includes a housing including first and second housing halves hingedly connected at one end, the first and second housing halves configured to pivot with respect to the other about a living hinge from a closed position to an open position, the living hinge interconnecting the first housing halve to the second housing halve, first and second connector ports configured to be removably coupled to the first and second fluid reservoirs, a static mixing cavity disposed in the housing and connected in fluid communication with the first and second connector ports, the static mixing cavity configured to promote mixing of first and second fluids supplied from the first and second fluid reservoirs, and a fluid outlet disposed in fluid communication with the static mixing chamber for dispensing a mixing fluid.

In some embodiments, the first and second housing halves each including one or more baffles, the one or more baffles cooperatingly configured to form a mechanical mixing cavity.

DESCRIPTION OF THE DRAWINGS

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

The following discussion provides examples of a device suitable for mixing liquids, pastes, creams, gels or other fluids. In some examples, the device includes a static mixer for mechanically mixing one or more fluids, such as one or more formulations. The fluids are introduced into a static mixing cavity, mechanically mixed by the static mixing cavity, and then dispensed from an outlet as a mixed fluid.

In some embodiments, the one or more formulations are cosmetic formulations, and may include but are not limited to various products for hair (e.g., coloration, cleansing, treatment, etc.), for skin (e.g., cleansing, anti-acne, makeup removal, etc.), for color cosmetics (e.g., foundations, liners, concealers, tints, etc.), etc. While the following examples describes the formulations as cosmetic formulations, it will be appreciated that the material to be mixed is not limited to the cosmetic field. Thus, static mixers of the present disclosure can be employed in any field of use where a mixing of fluids is desirable.

As will be described in more detail below, examples of the static mixer are configured to be reusable. In some embodiments, the static mixer is formed by two housing halves that are detachably coupled to one another via press fit structure, snap fit structure, or other suitable means, etc. In some embodiments, the two housing halves of the static mixer are hingedly connected so that the static mixer can be easily opened for cleaning the static mixing cavity. In some embodiments, the static mixer is formed by a single plastic (e.g., polypropylene, etc.) part with a living-hinge interconnecting the two housing halves.

As will be further described in more detail below, the static mixing cavity is configured to promote mixing of the one or more fluids as the fluid(s) traverse through the static mixer. For example, in some embodiments, the inside walls of the housing halves defining the static mixing cavity contain mixing features (e.g., ribs, baffles, etc.) that are intended to create turbulence and cumulative mixing forces. In some embodiments, the ribs, baffles, etc., are cooperatively configured on both housing halves to create a turbulent mixing path from fluid entrance into the static mixing cavity to fluid exit out of the static mixing cavity. In some embodiments, one or more of the ribs and/or baffles include holes positioned to maximize turbulence and mixing over the distance of formulation travel.

Figure 1:
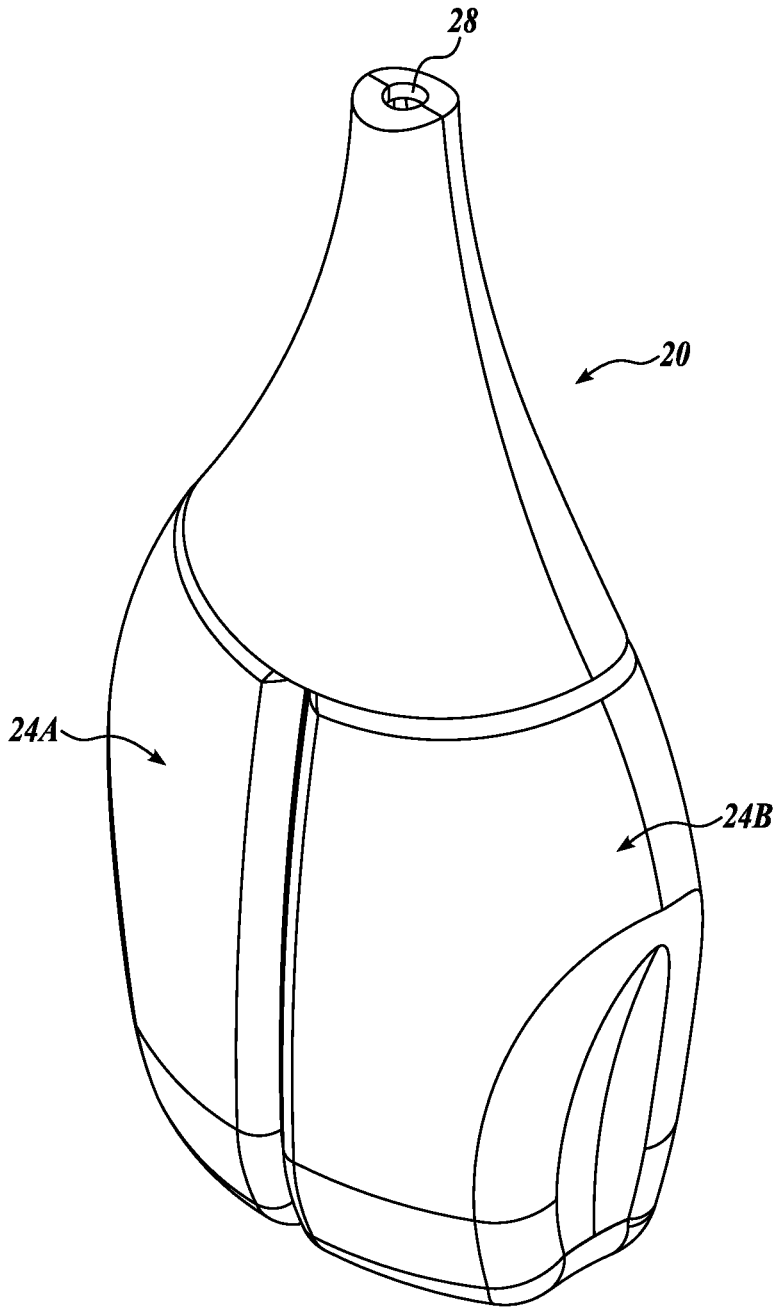
FIG. 1 is a perspective view of a representative embodiment of a static mixer in accordance with principles of the present disclosure, the static mixer shown with first and second fluid cartridges coupled thereto.
Figure 2:
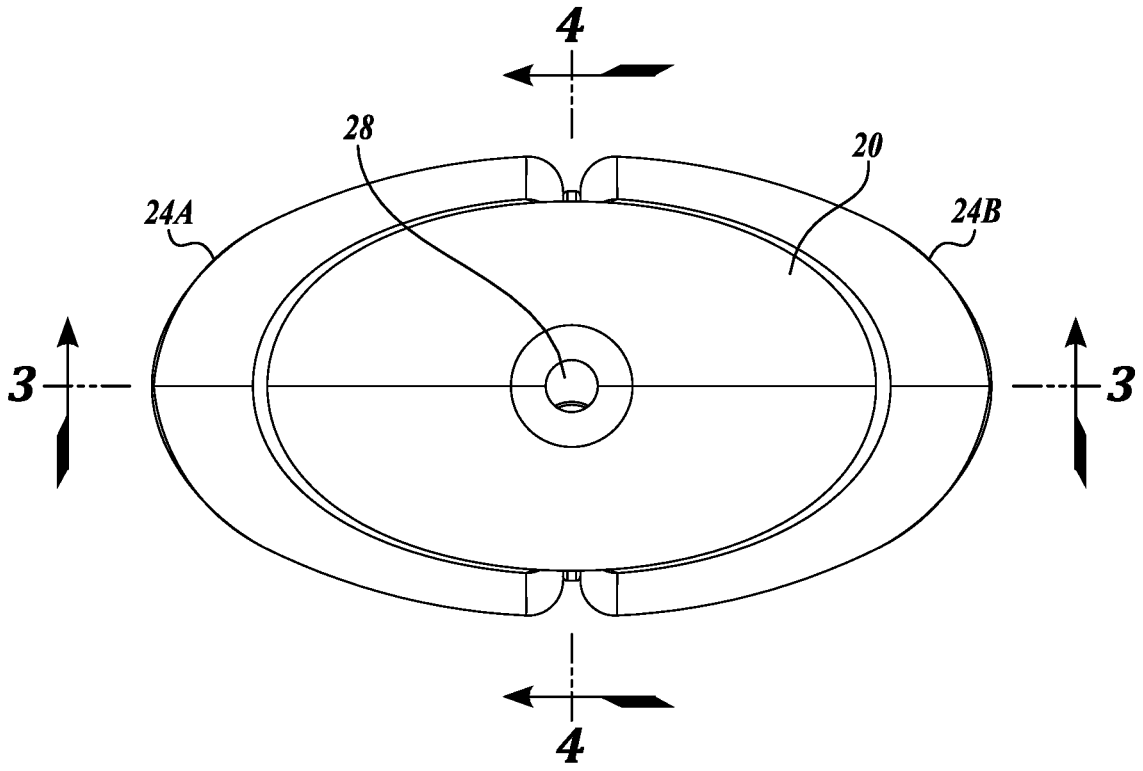
FIG. 2 is a top view of the static mixer of FIG. 1.

Turning now to FIGS. 1 and 2, there is shown perspective and top views, respectively, of a representative example of a static mixer, generally designated 20, formed in accordance with principles of the present disclosure. In the embodiment shown, the static mixer 20 is coupled to one or more fluid cartridges 24, such as first and second fluid cartridges 24A and 24B. In use, fluid stored in the first fluid cartridge 24A and/or second fluid cartridge 24B are introduced into the static mixer 20. As the fluid(s) from the first and/or second fluid cartridge traverse through the static mixer 20, the fluid(s) encounter mixing components (not shown) that introduce turbulence and cumulative mixing forces on the fluid(s). The fluid(s) from the first and/or second cartridge 24 exit the static mixer 20 from outlet port 28 as a single, mixed fluid, such as a mixed cosmetic formulation.

Figure 3:
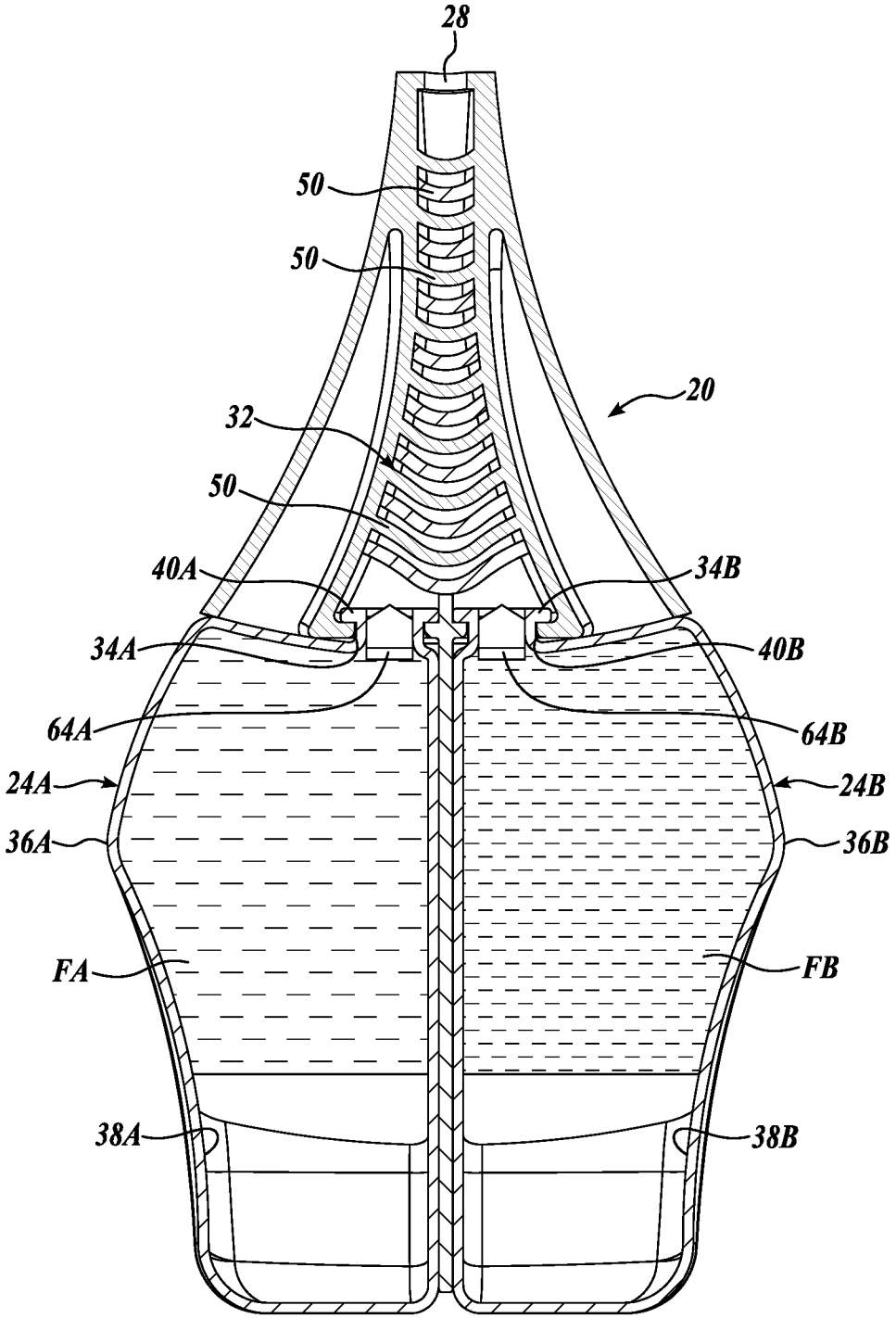
FIG. 3 is a cross-sectional view of the static mixer taken along the lines 3-3 of FIG. 2.
Figure 4:
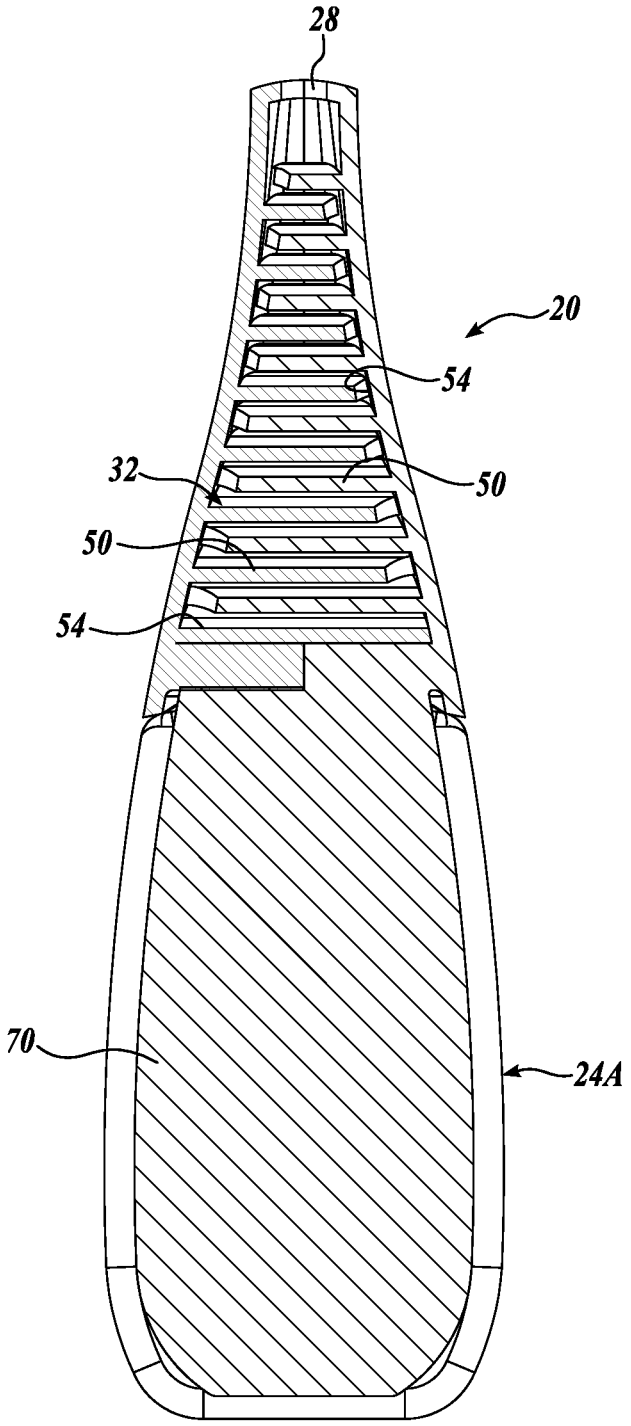
FIG. 4 is a cross-sectional view of the static mixer taken along the lines 4-4 of FIG. 2.

FIGS. 3 and 4 are longitudinal cross-sectional views of views of the static mixer of FIG. 1, taken along lines 3-3 and 4-4, respectively, in FIG. 2. As shown in FIGS. 3 and 4, the static mixer 20 includes a housing that defines a static mixing cavity 32. At one end of the housing there is provided at least one fluid connector port, shown as first and second connector ports 34A, 34B connected in fluid communication with the static mixing cavity 32. The first and second fluid connector ports 34A, 34B are connected in fluid communication with the static mixing cavity 32, which in turn, is connected in fluid communication with the outlet port 28. The outlet port 28 is arranged at the end of the housing 30 opposite the connector ports 34 for dispensing fluid introduced to the static mixing cavity 32 in a mixed manner. The first and second connector ports 34A, 34B are also adapted to be coupled in fluid communication with the first and second fluid cartridges 24.

Each fluid cartridge 24A, 24B includes a housing 36A, 36B that defines a fluid reservoir 38A, 38B for storing a fluid to be mixed by the static mixer 20. Each fluid cartridge 24 is configured to be coupled to the static mixer 20. In the embodiment shown, the first and second cartridges 24A, 24B, storing fluids FA, FB, are mounted on the top of the static mixer 20 in a side-by-side configuration. The fluid cartridges 24A, 24B include fluid fitting 40A, 40B, respectively, configured and arranged to be coupled to respective connector ports 34A, 34B. Once coupled, the fluid fittings 40A, 40B are configured to cooperate with the connector ports 34A, 34B to transfer the fluid from the fluid cartridges to the static mixing cavity 32 in a fluidically sealed manner.

Figure 7:
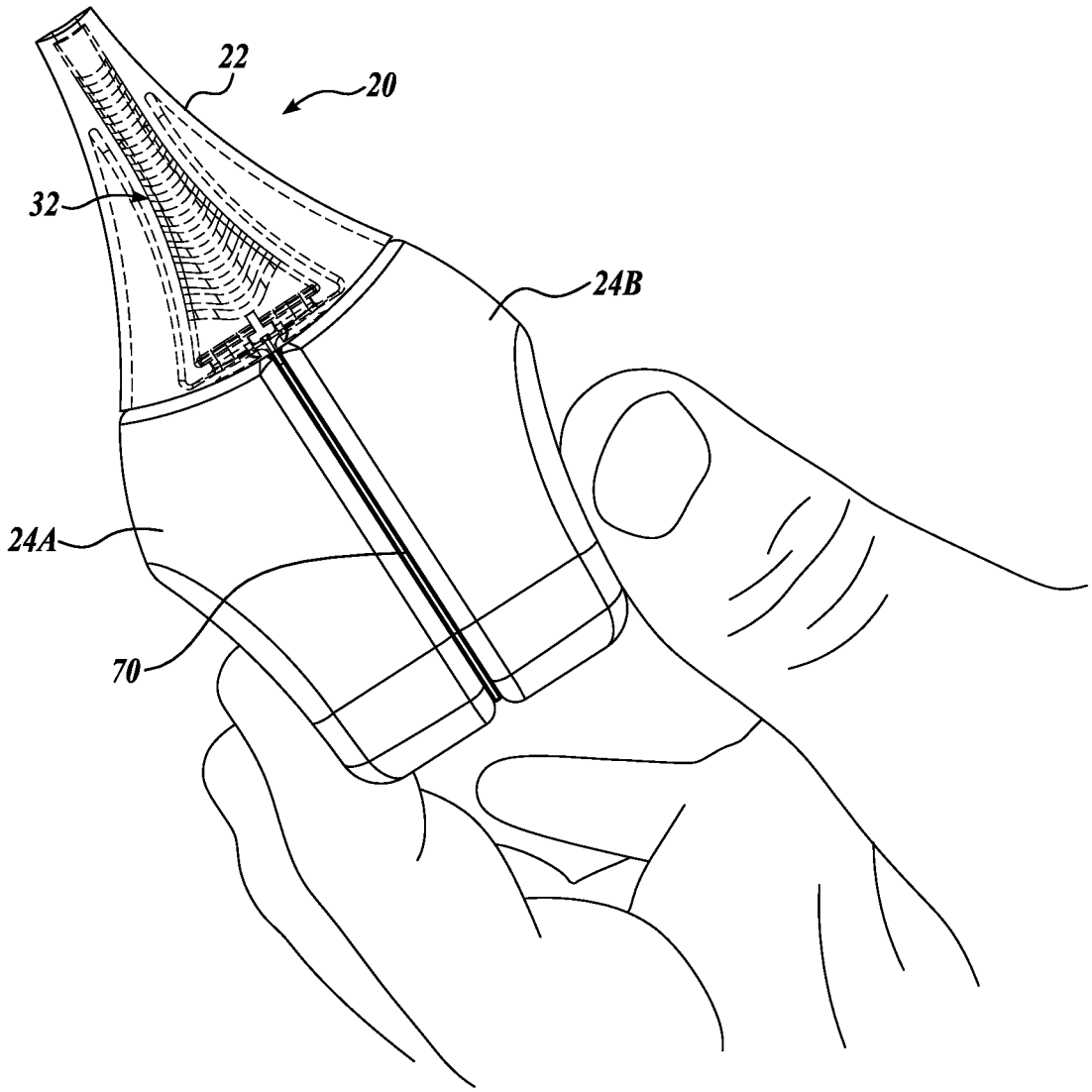
FIG. 7 is an isometric view of the static mixer and associated fluid cartridges in the hand of a user.

In some embodiments, the housing 36 of the fluid cartridges 24 are constructed of flexible plastic, such as polypropylene, polyethylene, synthetic rubber, such as silicon rubber, etc. In these embodiments, the fluid cartridges can, for example, be pressed or squeezed by a user's hand, as shown in FIG. 7, in order to increase the internal pressure within the fluid reservoir 38 to expel the fluid FA, FB from the cartridges 24 and into the static mixer 20. In some embodiments, the fluid fittings 40 are configured to be detachably coupled to the static mixer 20 so that the static mixer 20 can be reused with different cartridges, combinations of cartridges, etc.

Figure 5:
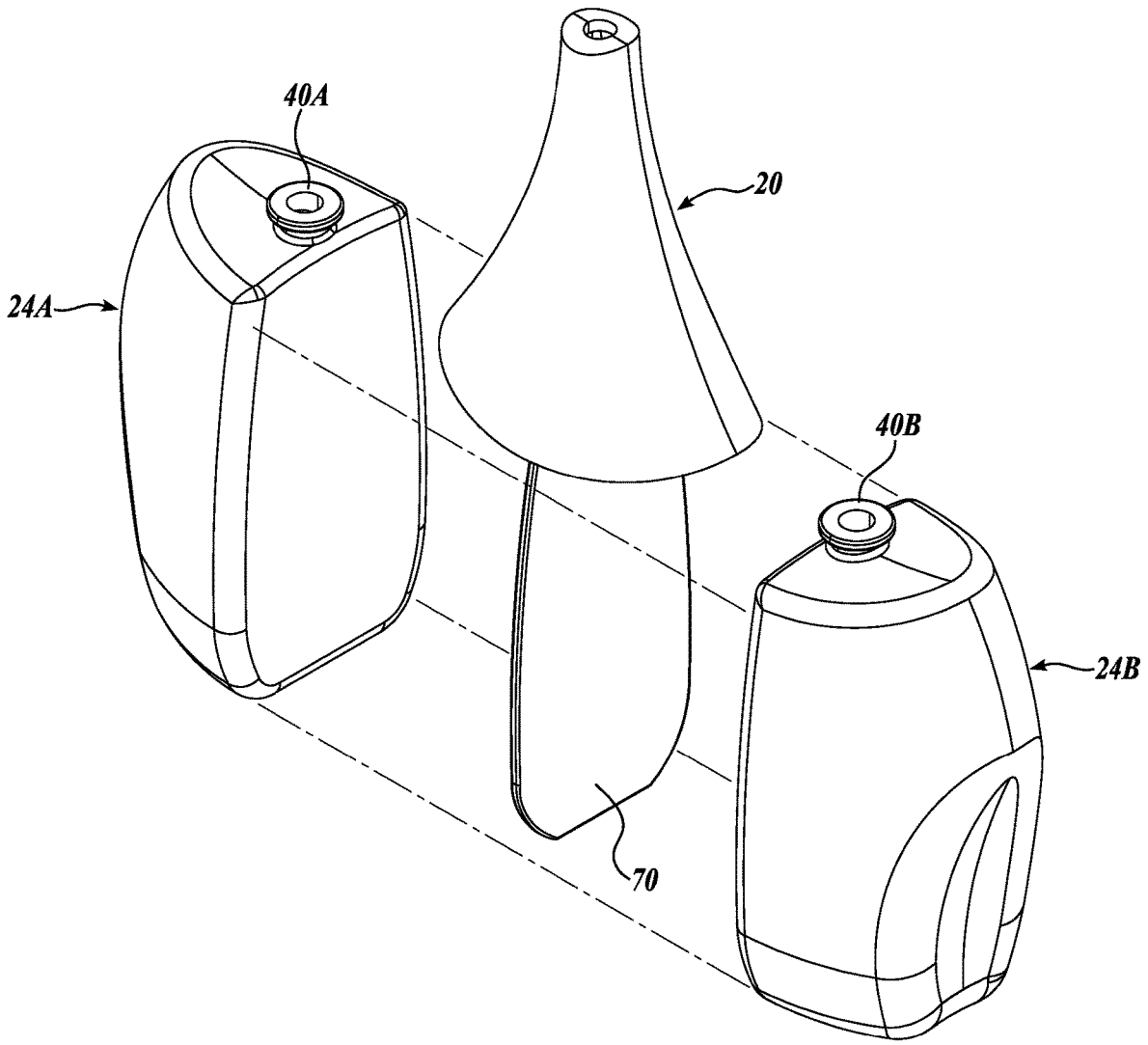
FIG. 5 is a partially exploded view of the static mixer of FIG. 1.
Figure 6A:
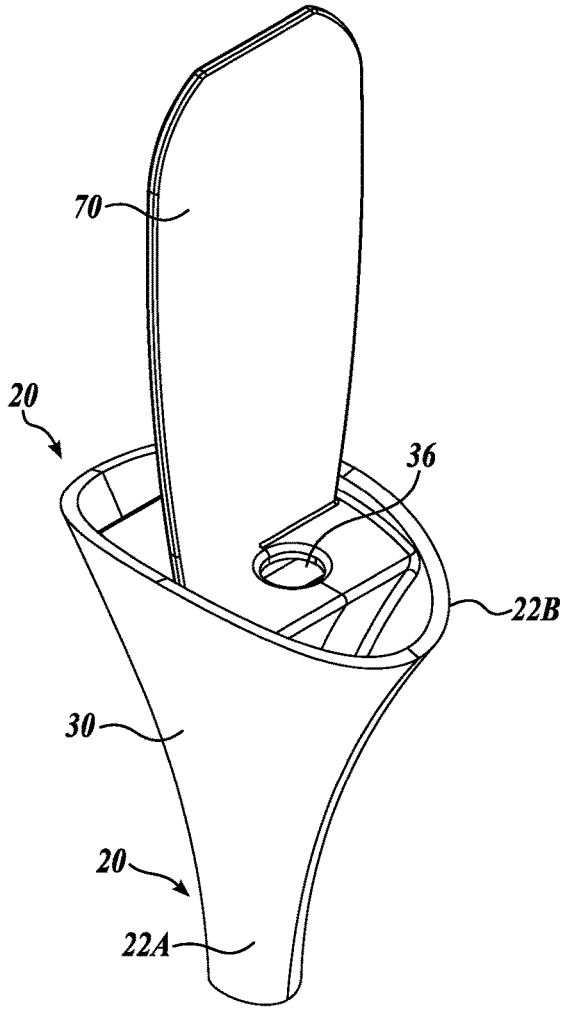
FIG. 6A is an isometric view of the static mixer of FIG. 1 in a closed position.
Figure 6B:
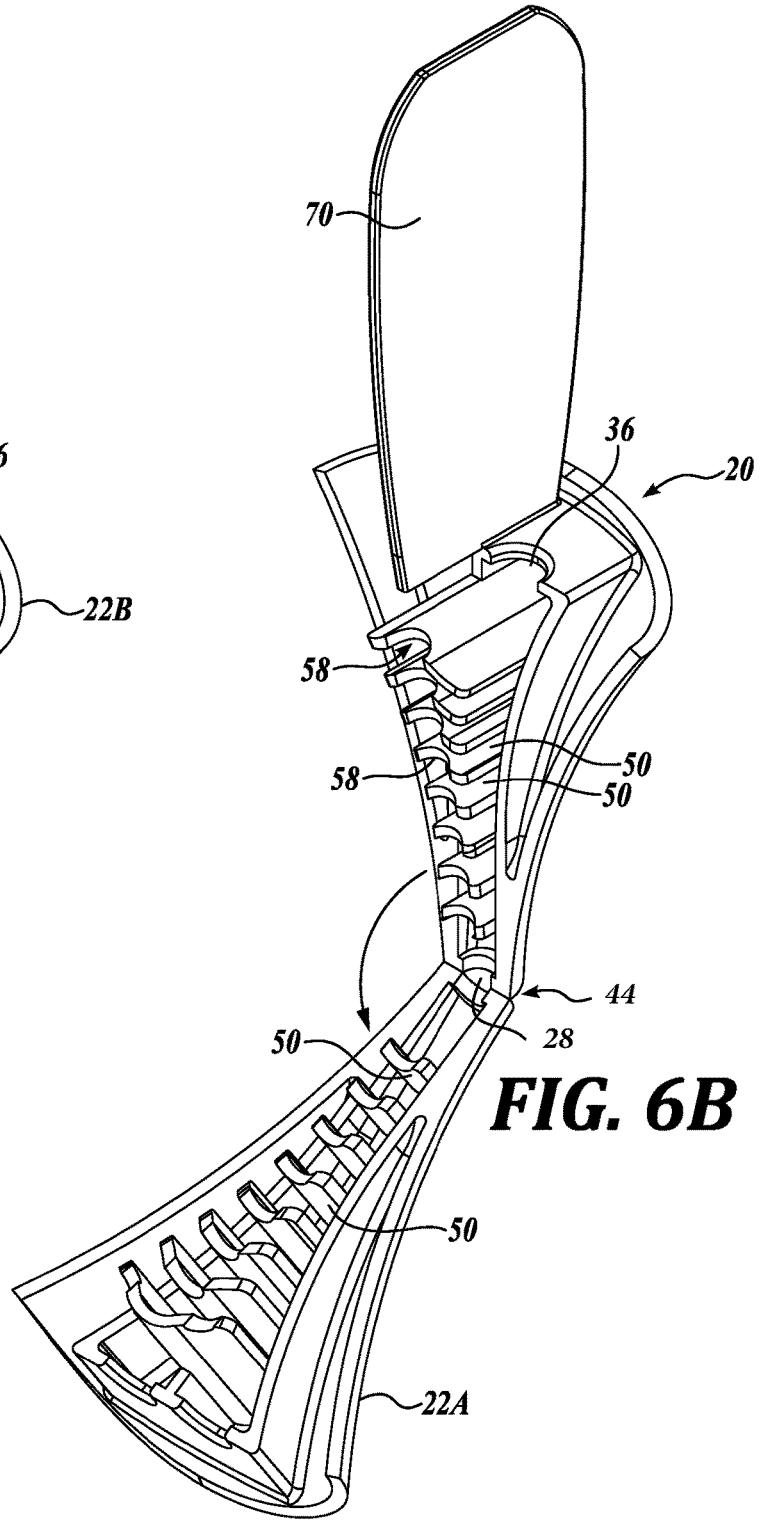
FIG. 6B is an isometric view of the static mixer of FIG. 1 in an open position.

In accordance with an aspect of the present disclosure, the static mixer 20 is configured to be cleaned in a simple manner to aid in reusing the static mixer with a variety of different products. In that regard, the housing of the static mixer 20 in some embodiments may be formed by two housing halves (shown as 22A, 22B in FIGS. 5 and 6A-6B) that are detachably coupled to one another via press fit structure, snap fit structure, etc. In some embodiments, the two housing halves of the static mixer 20 are also hingedly connected so that the static mixer 20 can be easily opened in a pivoting movement for cleaning the static mixing cavity, as shown in FIGS. 6A and 6B. In some embodiments, the static mixer 20 is formed by a single plastic (e.g., polypropylene, etc.) part with a living-hinge 44 that interconnects the first and second housing halves 22A, 22B. The living hinge 44 may be formed at the outlet port end of the housing 22. Alternatively, in other embodiments, the living hinge is formed at the connector port end of the housing 22.

In some embodiments, the fluid in each fluid cartridge 24 is a single fluid (e.g., yellow ink) intended to be mixed with another fluid (e.g., red ink) in the static mixing cavity 32 and dispensed from the outlet port 28 as a single mixture (e.g., orange ink). In some embodiments, the fluid in one or both fluid cartridges can be a homogenous fluid or formulation or a heterogenous fluid or formulation. In some embodiments, the static mixer 20 can statically mix a heterogenous formulation introduced from only one of the fluid cartridges.

In some embodiments, the fluid stored in the fluid cartridges can be a liquid, a paste, a gel, a cream, a sol, an emulsion, etc. In some embodiments, the fluids are cosmetic formulations, and may include but are not limited to various products for hair (e.g., coloration, cleansing, treatment, etc.), for skin (e.g., cleansing, anti-acne, makeup removal, etc.), for color cosmetics (e.g., foundations, liners, concealers, tints, etc.), etc.

Referring again to FIGS. 3 and 4 as well as FIG. 6B, the static mixer 20 also includes mixing components 50 that introduce, for example, turbulence and cumulative mixing forces to the fluid in the static mixing cavity 32. In some embodiments, the mixing components 50 include a plurality of baffles, ribs, etc., or other mixing structure associated with the static mixing cavity 32 that promote, for example, continuous mixing or blending of the one or more fluids as the one or more fluids traverse through the static mixer 20.

For example, in some embodiments, the inside walls of the housing halves 22A, 22B, which define the static mixing cavity 32, are formed with baffles, ribs, etc., that aim to create turbulence and cumulative mixing forces. In some embodiments, the ribs extend inwardly from the housing's inner walls and are cooperatively configured on both housing halves 22A, 22B to create a mechanical mixing path 54. As shown in FIG. 4, the path 54 may be somewhat serpentine in shape as the cavity 32 tapers to a smaller cross-section near the outlet 28 of the static mixer 20. In some embodiments, one or more of the ribs or baffles includes holes 58 positioned to maximize turbulence and mixing of the fluid as the fluids pass along the mixing path 54.

In some embodiments, a one-way valve or check valve can be used in order to permit fluid to flow into the static mixer from the fluid cartridges but to prohibit fluid from flowing out of the static mixer and back into the fluid cartridges. In the embodiment shown in FIG. 3, each fluid cartridge may include a check valve 64 associated with the fluid fitting 40. In the embodiment shown, the check valve 64 is of the duckbill valve type. In some embodiments, the check valve 64 can include but is not limited to one or more valves selected from the group consisting of a duckbill valve, a reed valve, a ball check valve, a diagram check valve, and a gate check valve. Additionally or alternatively, each of the connector ports 34 may include or is associated with a check valve 64. In any case, use of check valves can minimize or remove any cross contamination between the formulas during and/or after mixing.

One example of the method for using the static mixer 20 to mix one or more fluids will now be described with reference to FIGS. 3, 4, and 7. Firstly, one or more fluids, such as FA, FB, to be mixed are selected, and their respective cartridges 24A, 24B are coupled to the static mixer 20, as shown in FIGS. 3 and 4. In that regard, each cartridge 24A, 24B is coupled to the static mixer 20 such that the connector fittings 40A, 40B are disposed in fluid communication with the connector ports 34A, 34B. In the embodiment shown, the cartridges 24A, 24B are positioned in a side by side configuration.

Next, pressure is applied to the cartridges 24A, 24B, for example, by pressing the cartridges laterally inwardly from diametrically opposite sides with a user's fingers and/or thumb, as shown in FIG. 7. Pressing the sides of the flexible cartridge causes an increase in the internal pressure within the fluid reservoirs of the cartridges, and forces the fluids FA, FB into the static mixing cavity 32 through the connector fittings/connector ports. Continued increasing pressure forces the fluids FA, FB through the static mixer 20 and out of the outlet 28. As the fluids FA, FB are forced through the static mixing cavity, the fluids traverse a mechanical mixing path 54 causing continuous mixing or blending of the fluids. The mixed or blended fluids are then expelled from the static mixer through the outlet 28.

To clean the static mixer 20, the cartridges 24A, 24B are decoupled from the static mixer 20. Next, one housing half 22A or 22B is separated from the other housing half 22A or 22B. In some embodiments, the one housing half 22A or 22B is separated from the other housing half 22A or 22B by pivoting movement about a hinge, such as living hinge 44. Once separated, the internal structure (e.g., baffles, ribs, internal walls, etc.) of the housing halves 22A, 22B can be cleaned. The housing halves 22A, 22B are then coupled together for subsequent use with cartridges containing the same or different fluids.

In some embodiments, the fluids contained in the fluid cartridges 24A, 24B have a similar viscosity. Similar viscosity of the fluids aid in an effective, balanced mixing. To further support a balanced ratio of the fluids in the mixed fluid, the device 20 in some embodiments may further include a force balancing mechanism. For example, in the embodiment shown, the force balancing mechanism includes a stiff, paddle-like structure 70 that extends outwardly from the connector port end of the housing 22. The paddle-like structure 70 is positioned between the connector ports 34A. 34B and extends in the direction opposite the static mixing cavity 32. When assembled, the cartridges 24A, 24B are disposed on either side of the paddle-like structure 70.

In the embodiment shown, the paddle-like structure 70 defines opposite, flat surfaces. The paddle-like structure 70 can be constructed from the same material as the housing 22, and in some embodiments, the paddle-like structure can be integrally formed with the housing. In these embodiments, the paddle-like structure 70 is cantilevered from the housing so that the paddle-like structure 70 flexes laterally, as needed, to promote equal forces in the cartridges as they are pressed inwardly from diametrically opposite sides by the user's fingers and/or thumb, as shown in FIG. 7.

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result. Moreover, some of the method steps can be carried serially or in parallel, or in any order unless specifically expressed or understood in the context of other method steps.

In the foregoing description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "forward," "rearward," "front," "back," "upward," "downward," "right hand," " " "lateral left hand," "medial," in, "out," "extended," "advanced," "retracted," "proximal," "distal," "central," etc. These references, and other similar references in the present application, are only to assist in helping describe and understand the particular embodiment and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also, in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value.

Throughout this specification, terms of art may be used. These terms are to take on their ordinary meaning in the art from which they come, unless specifically defined herein or the context of their use would clearly suggest otherwise.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. A fluid mixing system, comprising:

first and second fluid cartridges having first and second fluid connector fittings, respectively, the first and second cartridges having a flexible housing configured so that when pressed, forces are applied to a fluid contained therein;

a static mixer including:

a housing that includes a first housing half and a second housing half hingedly connected at one end, the first housing half and the second housing half configured to pivot with respect to the other about a hinge from a closed position to an open position;

first and second connector ports configured to be removably coupled to the first and second fluid connector fittings;

a static mixing cavity disposed in the housing and connected in fluid communication with the first and second connector ports, the static mixing cavity configured to promote mixing of one or more fluids supplied thereto from the first and second fluid cartridges as the one or more fluids pass through the static mixing cavity; and a fluid outlet disposed in fluid communication with the static mixing cavity for dispensing a mixing fluid.

2. The fluid mixing system of claim 1, wherein the housing includes a plurality of baffles arranged to form a mechanical mixing path in the static mixing cavity.

3. The fluid mixing system of claim 1, further comprising check valves associated with the one of the first and second connector ports or the first and second fluid connector fittings.

4. The fluid mixing system of claim 1, wherein the hinge is a living hinge interconnecting the first housing half to the second housing half.

5. The fluid mixing system of claim 1, further comprising an elongate member cantilevered outwardly from the static mixer, the elongate member positioned in-between the first and second cartridges.

6. The fluid mixing system of claim 2, wherein the first housing half and the second housing half each include baffles of the plurality of baffles, the baffles cooperatingly configured to form the mechanical mixing path in the static mixing cavity.

7. The fluid mixing system of claim 6, wherein one or more of the plurality of baffles includes a hole for fluid passage through the baffle.

8. A fluid mixing system, comprising:

first and second fluid cartridges having first and second fluid connector fittings, respectively, the first and second cartridges having a flexible housing configured so that when pressed, forces are applied to a fluid contained therein;

a static mixer including:

a housing;

first and second connector ports configured to be removably coupled to the first and second fluid connector fittings;

a static mixing cavity disposed in the housing and connected in fluid communication with the first and second connector ports, the static mixing cavity configured to promote mixing of one or more fluids supplied thereto from the first and second fluid cartridges as the one or more fluids pass through the static mixing cavity; and a fluid outlet disposed in fluid communication with the static mixing cavity for dispensing a mixing fluid, wherein the housing includes a plurality of baffles arranged to form a mechanical mixing path in the static mixing cavity, and wherein one or more of the plurality of baffles includes a hole for fluid passage through the baffle.

9. A fluid mixing system, comprising:

first and second fluid reservoirs storing first and second fluids;

a static mixer including:

a housing including a first housing half and second housing half hingedly connected at one end, the first housing half and the second housing half configured to pivot with respect to the other about a living hinge from a closed position to an open position, the living hinge interconnecting the first housing half to the second housing half;

first and second connector ports configured to be removably coupled to the first and second fluid reservoirs;

a static mixing cavity disposed in the housing and connected in fluid communication with the first and second connector ports, the static mixing cavity configured to promote mixing of first and second fluids supplied from the first and second fluid reservoirs; and a fluid outlet disposed in fluid communication with the static mixing cavity for dispensing a mixing fluid.

10. The fluid mixing system of claim 9, wherein the first housing half and the second housing half each including one or more baffles, the one or more baffles cooperatingly configured to form a mechanical mixing cavity.

11. The fluid mixing system of claim 9, further comprising a flat member cantilevered outwardly from the static mixer, the flat member positioned in-between the first and second reservoirs.

* * * * *